US010716962B2

(12) United States Patent
Chen et al.

(10) Patent No.: US 10,716,962 B2
(45) Date of Patent: Jul. 21, 2020

(54) ESCAPE POD

(71) Applicant: Shaochun Chen, Hangzhou, Zhejiang (CN)

(72) Inventors: Shaochun Chen, Zhejiang (CN); Xulong Chen, Zhejiang (CN); Wenfei Yu, Zhejiang (CN); Xuqiang Chen, Zhejiang (CN)

(73) Assignee: Shaochun Chen, Hangzhou (CN)

( * ) Notice: Subject to any disclaimer, the term of this patent is extended or adjusted under 35 U.S.C. 154(b) by 97 days.

(21) Appl. No.: 16/027,228

(22) Filed: Jul. 3, 2018

(65) Prior Publication Data

US 2019/0022435 A1 Jan. 24, 2019

(30) Foreign Application Priority Data

Jul. 18, 2017 (CN) ..... 2017 1 0587496

(51) Int. Cl.
*A62B 31/00* (2006.01)
*E04H 9/02* (2006.01)
*A62B 5/00* (2006.01)

(52) U.S. Cl.
CPC ..... *A62B 31/00* (2013.01); *E04H 9/028* (2013.01); *A62B 5/00* (2013.01)

(58) Field of Classification Search
CPC ..... E04H 9/029; E04H 9/028; E04H 9/145; A62B 31/00; E04B 1/3211
See application file for complete search history.

(56) References Cited

U.S. PATENT DOCUMENTS 4,824,099 A * 4/1989 Rusu ..... A63G 31/00 434/55
5,060,932 A * 10/1991 Yamaguchi ..... A63G 31/16 434/34
5,398,678 A * 3/1995 Gamow ..... A61G 10/026 128/202.12
6,938,381 B1 * 9/2005 Villa ..... E04B 1/3211 52/79.1
7,856,762 B2 * 12/2010 Deisenroth ..... B60N 2/4242 52/143
9,789,411 B2 * 10/2017 Masutti ..... A63G 31/16
2013/0014791 A1 * 1/2013 Hill ..... E04H 9/028 135/93

FOREIGN PATENT DOCUMENTS

WO WO-2013073060 A1 * 5/2013 ..... E04H 9/029
WO WO-2015191015 A1 * 12/2015 ..... A62B 99/00

* cited by examiner

*Primary Examiner* — Christine T Cajilig

(57) ABSTRACT

An escape pod includes a spherical survival chamber, a gimbal mechanism, and a spherical outer case body. The survival chamber is mounted on an inner side of the gimbal mechanism, and an outer side of the gimbal mechanism is mounted within the outer case body. Top and bottom ends of the outer case body are provided symmetrically with upper and lower connecting terminals. The outer case body includes a plurality of arc-shaped plates. Two ends of each arc-shaped plate are fixedly connected to the upper and lower connecting terminals respectively. An inner side of the arc-shaped plate is provided with a reinforcing framework. The reinforcing framework is formed of a plurality of arc-shaped steel pipes. Top and bottom ends of each arc-shaped steel pipe are connected to the upper and lower connecting terminals. One of the arc-shaped plates is provided with a pod door.

10 Claims, 7 Drawing Sheets

ESCAPE POD

CROSS REFERENCE TO RELATED APPLICATIONS

The present application claims the benefit of Chinese Patent Application No. 201710587496.0 filed on Jul. 18, 2017, the contents of which are hereby incorporated by reference.

TECHNICAL FIELD

The present disclosure relates to an escape pod and belongs to the technical field of escape pod.

BACKGROUND

Currently, escape pods for earthquake, fire and accident involving life and safety are mainly spherical or cabinet-type in structure. The former is represented by Noah products manufactured by New Cosmopower in Japan, while the latter is manufactured by small manufacturers in the People's Republic of China. The spherical escape pods are ready to move or rotate by the impact of external load, can reduce the impact force, and have strong impact resistance. However, these spherical escape pods are extremely inconvenient to use because an average person's height is several times longer than the person's width. Hence, when the person enters a spherical escape pod, the space along the width direction of the person's body is wasted. If the pod body is small, an adult inside is difficult to maintain a normal body posture, and comfort is greatly reduced. If the pod body is too large, it needs to occupy a larger space. Although the cabinet-type escape pod is more comfortable than the spherical escape pod, it is difficult to displace under the impact of external load. Furthermore, load-withstanding capacity of the structure is irrational, and as such impact resistance is low. Upon impact of a large external force, it is easy to be crushed by collapsed substances, thereby causing casualties. For a toppling collapse of high-rise buildings, it basically cannot roll because of its limitation in structure and therefore the probability of survival of people is reduced.

In summary, in order to solve the existing problems of technology, it is urgent to invent an escape pod that has a rectangular exterior and a spherical interior, a simple structure, and a rational load-withstanding structure, which is safe and reliable.

SUMMARY

The present disclosure provides an escape pod that has a rectangular exterior and a spherical interior, a simple structure, and a rational load-withstanding structure, which is safe and reliable, and can solve the problems existing in the present technology.

To solve the above technical problems, the technical solutions of the present disclosure are as follows:

According to one aspect, there is provided an escape pod, including a spherical survival chamber; a gimbal mechanism; and a spherical outer case body, wherein the survival chamber is mounted on an inner side of the gimbal mechanism, and an outer side of the gimbal mechanism is mounted within the outer case body, a top end and a bottom end of the outer case body being provided symmetrically with an upper connecting terminal and a lower connecting terminal, wherein the outer case body comprises a plurality of arc-shaped plates, and two ends of each arc-shaped plate are fixedly connected to the upper and lower connecting terminals respectively, an interior of the arc-shaped plate being provided with a reinforcing framework, the reinforcing framework being installed on the interior of the arc-shaped plates provided at corresponding intervals, the reinforcing framework being formed of a plurality of arc-shaped steel pipes, a top end and a bottom end of each arc-shaped steel pipe being fixedly connected to the upper and lower connecting terminals, wherein one of the arc-shaped plates is openable and used as a pod door.

Preferably, the gimbal mechanism includes a first circular ring; a second circular ring; and a plurality of first universal joints and second universal joints, wherein a top end and a bottom end of the first circular ring are connected to an inner side of the second circular ring by two of the first universal joints respectively, and two outer level ends of the second circular ring are provided symmetrically with two connecting shafts respectively, one end of each connecting shaft being installed in an inner wall of the arc-shaped plate, and two outer level ends of the survival chamber being provided symmetrically with two of the second universal joints that connect to an inner wall of the first circular ring.

Preferably, the inner wall of the arc-shaped plate is provided with an installation groove for installing another end of each connecting shaft, and the another end of each connecting shaft is provided with a damping block in its corresponding installation groove, an outer wall of each damping block being provided symmetrically with a plurality of damping springs, and another end of each damping spring being fixedly connected to an inner wall of the installation groove.

Preferably, the escape pod further includes a peripheral skeleton, wherein an outer side of the outer case body is provided symmetrically with a plurality of connecting ends, wherein each connecting end is connected to an inner side of the peripheral skeleton through an elastic rope.

Preferably, an outer side of the peripheral skeleton is covered with a plurality of flame retardant boards.

Preferably, the arc-shaped steel pipes are seamless steel pipes, and oxygen is stored in the arc-shaped steel pipes, a first ventilation passage, a second ventilation passage, a third ventilation passage, a fourth ventilation passage, and a fifth ventilation passage are respectively arranged inside the connecting shafts, the second circular ring, the first universal joints, the first circular ring and the second universal joints; the arc-shaped steel pipes communicates with the first ventilation passage in the connecting shafts, and the first ventilation passage, the second ventilation passage, the third ventilation passage, the fourth ventilation passage, and the fifth ventilation passage are sequentially connected; the fifth ventilation passage is connected to the survival chamber.

Preferably, each connecting terminal is provided with a pulling ring.

Preferably, a plurality of air vents is provided on the outer case body.

Preferably, a top of the pod door and the upper connecting terminal are connected by a hinge The present disclosure has the following characteristics and beneficial effects:

Adopting the above technical solutions, one can avoid any natural or man-made disasters for a short period of time in the survival chamber so as to ensure personal safety.

BRIEF DESCRIPTION OF THE DRAWINGS

In order to more clearly illustrate the technical solution provided by the embodiments of the present disclosure, the drawings to be used in the description of the embodiments will be briefly described below. It will be apparent that the drawings mentioned in the following description are merely some implementations of the present disclosure. Without making any creative effort, a person skilled in the art may derive other drawings from the drawings in the present application; wherein.

In the drawings.

1—survival chamber; 2—second circular ring; 3—first circular ring; 4—first universal joint; 40—second universal joint; 5—outer case body; 51—arc-shaped plate; 52—air vent; 53—pod door; 6—reinforcing framework; 61—arc-shaped steel pipe; 7—damping mechanism; 71—damping spring; 72—damping block; 73—connecting shaft; 8—installation groove; 9—pulling ring; 10—connecting terminal; 11—flame retardant board; 12—elastic rope; 13—peripheral skeleton; 14—hinge; 731—first ventilation passage; 21—second ventilation passage; 41—third ventilation passage; 31—fourth ventilation passage; 401—fifth ventilation passage.

DETAILED DESCRIPTION

The embodiments of the present Invention are further described in conjunction with the accompanying drawings. It is to be stated that the description of the embodiments is used to assist the understanding the present Invention but does not constitute a limitation to the present Invention. In addition, the technical features involved in each embodiment of the disclosure described below can be combined as long as they do not constitute a conflict.

Embodiment 1

Figure 1:
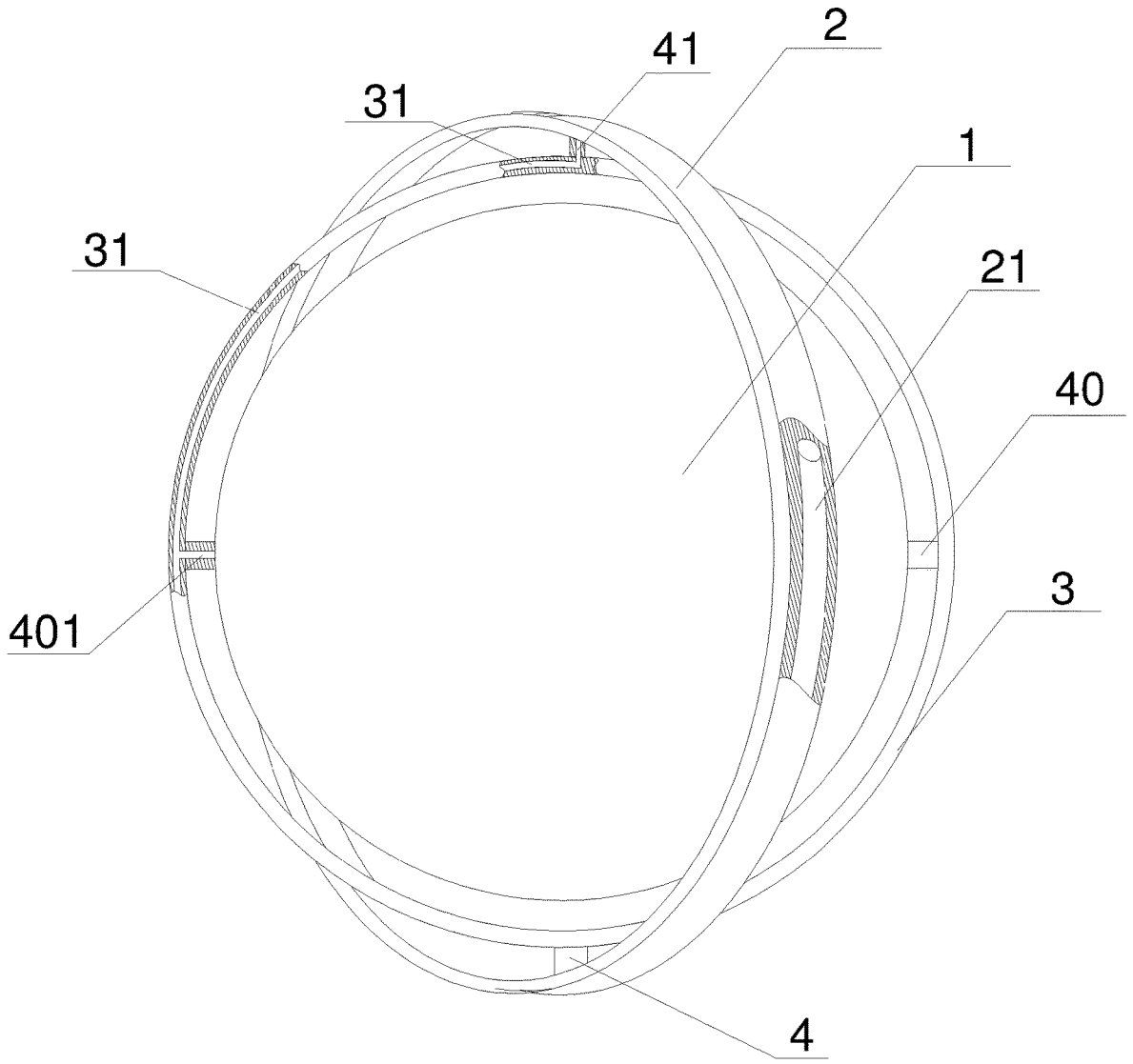
FIG. 1 is a schematic diagram of the structure of an escape pod according to an Embodiment 1 of the present Invention.
Figure 2:
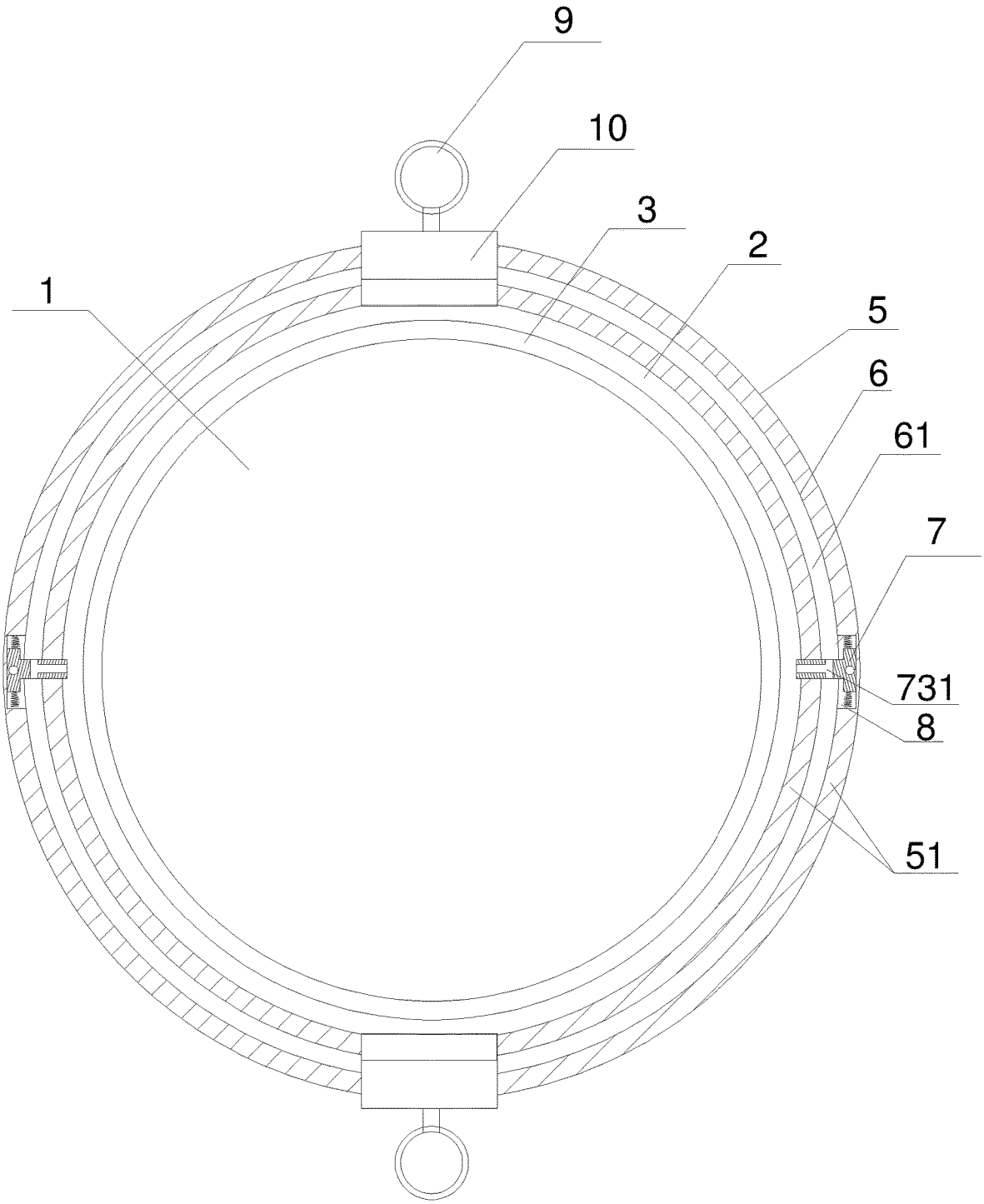
FIG. 2 is a schematic diagram of a longitudinal section of an escape pod in the Embodiment 1.
Figure 6:
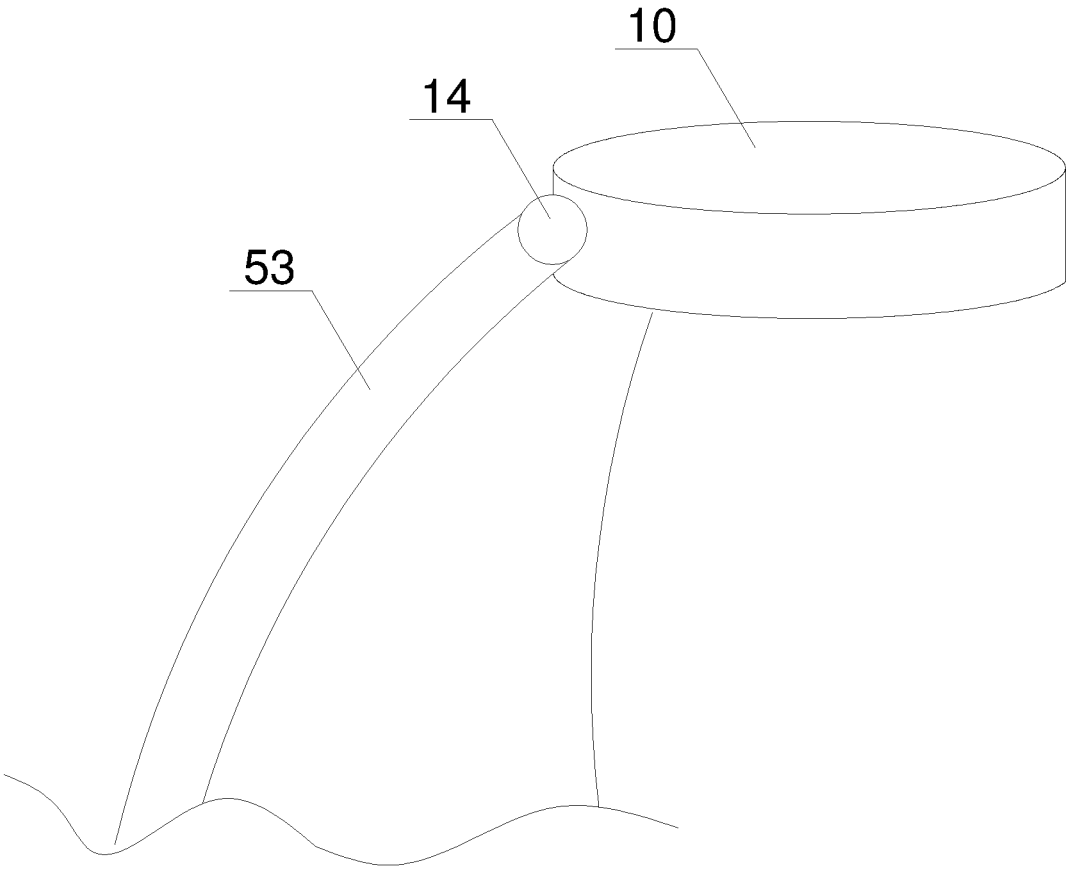
FIG. 6 is a schematic diagram of a part of the structure of the escape pod according to an Embodiment 2 of the present Invention.
Figure 7:
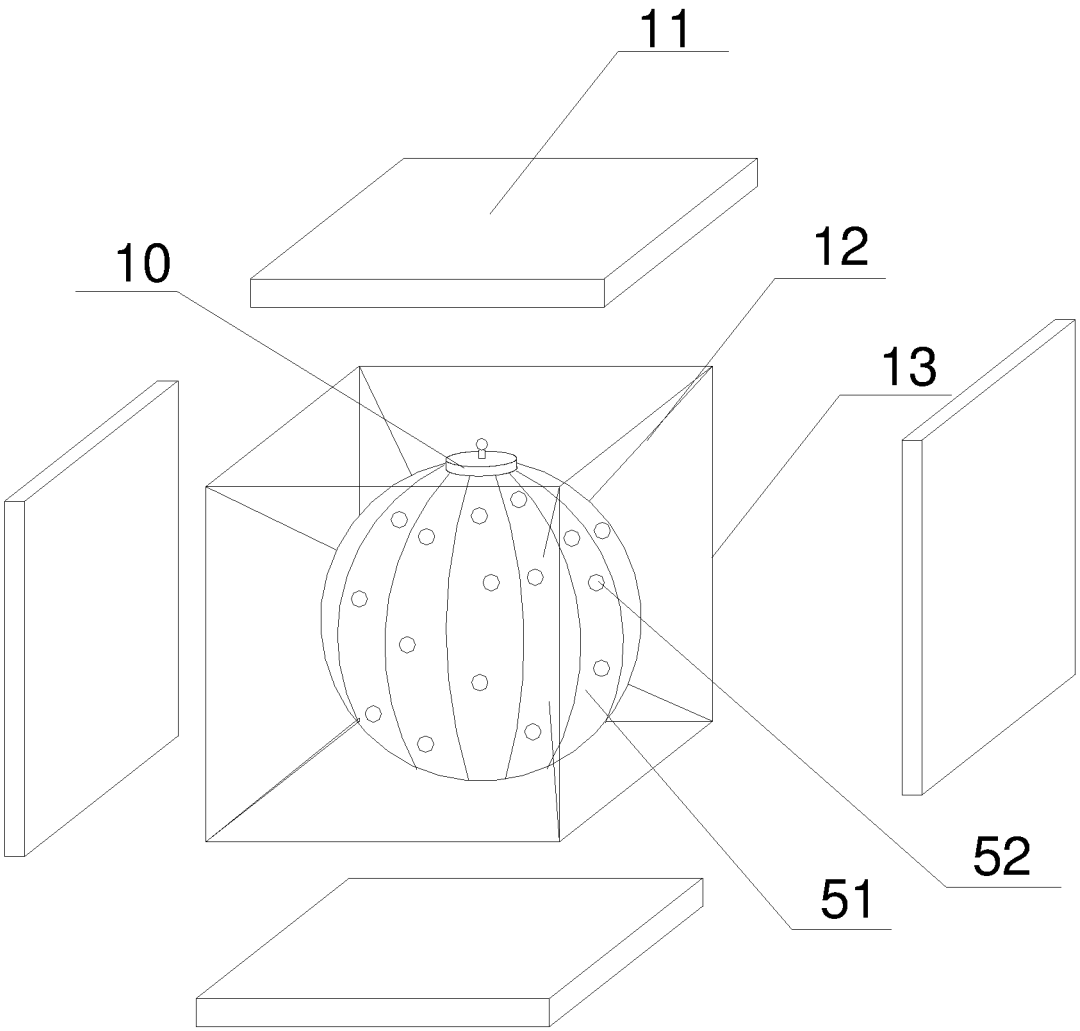
FIG. 7 is a schematic diagram according to an Embodiment 2 of the present Invention.

Referring to FIGS. 1-7, as shown in FIGS. 1 and 2, the present Invention provides an escape pod including a spherical survival chamber 1, a gimbal mechanism, and a spherical outer case body 5. The survival chamber 1 is mounted on an inner side of the gimbal mechanism, and an outer side of the gimbal mechanism is mounted in the outer case body 5. A top end and a bottom end of the outer case body 5 are provided symmetrically with upper and lower connecting terminals 10. The outer case body 5 includes a plurality of arc-shaped plates 51, and two ends of each arc-shaped plate are fixedly connected to the upper and lower connecting terminals 10 respectively. An inner side of the arc-shaped plate is provided with a reinforcing framework 6. The reinforcing framework 6 is installed on the interior of the arc-shaped plates provided at corresponding intervals. The reinforcing framework 6 is formed of a plurality of arc-shaped steel pipes 61. A top end and a bottom end of each arc-shaped steel pipe 61 are fixedly connected to the upper and lower connecting terminals 10 respectively. One of the arc-shaped plates is openable and used as a pod door 53. As shown in FIG. 6, a top of the pod door 53 and the upper connecting terminal 10 are connected by a hinge 14.

Further, the arc-shaped steel pipes 61 are seamless steel pipes, and oxygen is stored in the arc-shaped steel pipes. A first ventilation passage 731, a second ventilation passage 21, a third ventilation passage 41, a fourth ventilation passage 31 and a fifth ventilation passage 401 are respectively arranged inside the connecting shafts 73, the second circular ring 2, the first universal joints 4, the first circular ring 3 and the second universal joints 40; the arc-shaped steel pipes 61 communicates with the first ventilation passage 731 in the connecting shafts; the first ventilation passage 731, the second ventilation passage 21, the third ventilation passage 41, the fourth ventilation passage 31, and the fifth ventilation passage 401 are sequentially connected; the fifth ventilation passage 401 is connected to the survival chamber 1.

In the above technical solutions, the survival chamber 1 is installed in the outer case body 5 through the gimbal mechanism, so that the survival chamber 1 can adapt to human survival in any position. The survival chamber 1 will not arbitrarily change its orientation due to the rolling motion of the outer case body 5. In addition, through the storage of oxygen in the arc-shaped steel pipes 61, the amount of oxygen in the survival chamber 1 can be ensured, thereby prolonging the survival time in the survival chamber 1.

It is understood that the survival chamber 1 is provided with supplies necessary for human survival. These supplies may include compressed food, drinking water, high-frequency walkie-talkie, mobile phone, lithium battery, self-defense device, life jacket, helmet, gloves, anti-radiation winter clothes, sleeping bag, flint, rope, electronic watch, nutrition powder, etc.

Specifically, the gimbal mechanism includes a first circular ring 3, a second circular ring 2, and a plurality of first and second universal joints. A top end and a bottom end of the first circular ring 3 connect to an inner side of the second circular ring 2 by two of the first universal joints 4 respectively. Two outer level ends of the second circular ring 2 are provided symmetrically with two connecting shafts 73 respectively. One end of each connecting shaft 73 is installed in an inner wall of the arc-shaped plate 61. Two outer level ends of the survival chamber 1 are provided symmetrically with two of the second universal joints 40 that connect to an inner wall of the first circular ring 3.

Specifically, the inner wall of the arc-shaped plate 51 is provided with an installation groove 8 for installing another end of each connecting shaft 73. The another end of each connecting shaft 73 is provided with a damping block 72 in its corresponding installation groove. An outer wall of each damping block 72 is provided symmetrically with a plurality of damping springs 71. Another end of each damping spring 71 is fixedly connected to an inner wall of the installation groove 8.

Figure 3:
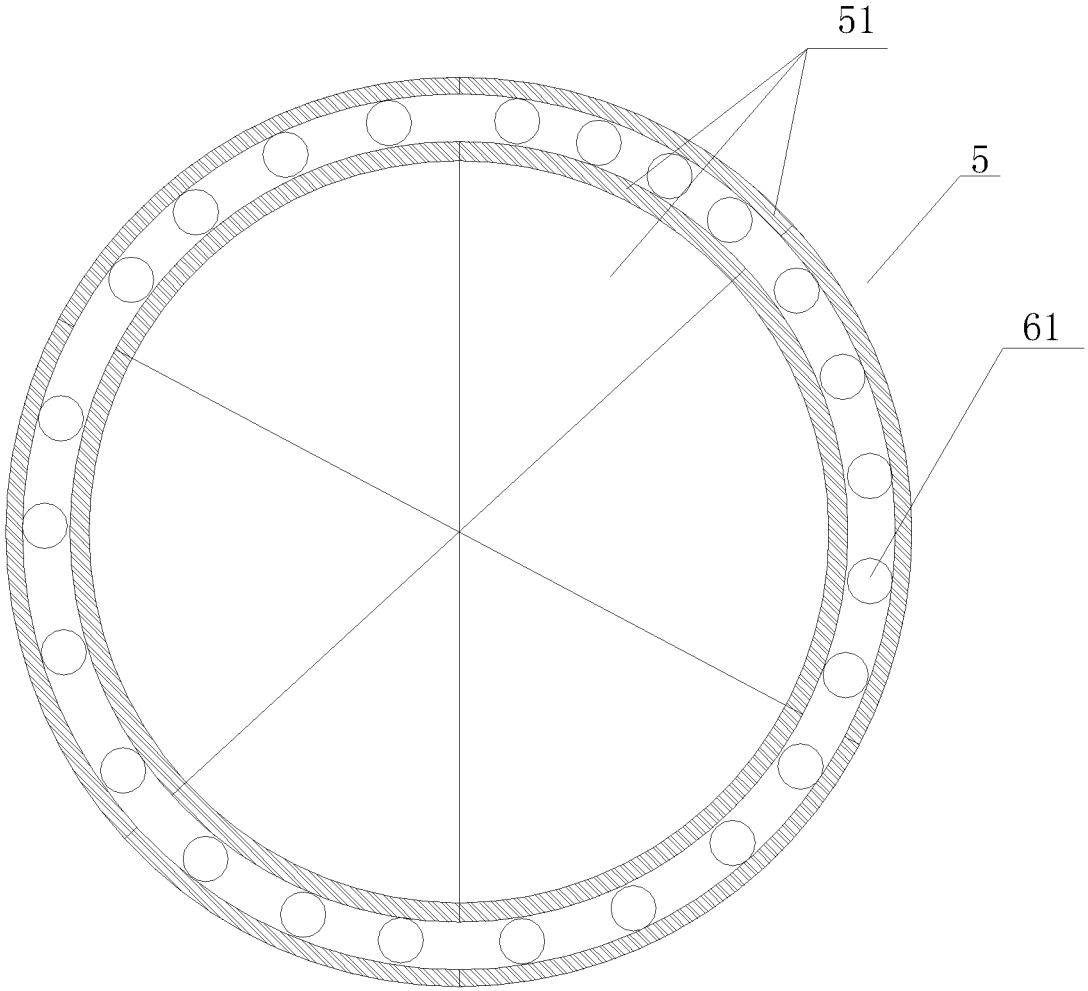
FIG. 3 is a schematic diagram of a cross-section of an outer case body in the Embodiment 1.

In the above technical solution, certain damping effect on the survival chamber 1 and the connecting shafts 73 are achieved through the mating of the damping blocks 72 and damping springs 71 (FIG. 3). This can enhance the usage of the escape pod and reduce the harm that may cause to the body of the person inside the survival chamber 1.

It is understood that the inner wall of the survival chamber 1 is provided with airbags. An excellent protective effect on the body of the person is achieved through the airbags.

It is understood that the outer case body 5 is equipped with multiple sets of cameras, multiple sets of temperature sensor, external barometer, oxygen gauge, external air quality meter, multiple sets of high-pitched alarm so that one can accurately aware of the environment outside the survival chamber 1. This can avoid people from leaving the survival chamber 1 without knowing the external situation. This can ensure that people's lives are safe. In addition, a display screen may be provided inside the survival chamber 1 to display the external environment.

It is understood that a manual power generator is provided inside the survival chamber 1. Electricity can be supplied to electronic devices inside the survival chamber 1 by means of the manual power generator.

It is understood that a position locator is provided on the outer wall of the outer case body 5 so that rescuers can locate the position of the escape pod and save the person inside the escape pod in time.

Furthermore, pulling rings 9 are provided on the connecting terminals 10. The pulling rings 9 can facilitate pulling of the escape pod by equipment.

Furthermore, a plurality of air vents 52 is provided on the outer case body 5. Air inside the survival chamber 1 can be exchanged in time through the air vents to ensure the amount of oxygen inside the survival chamber 1 and the living environment within the survival chamber 1 can be maintained.

Embodiment 2

Figure 4:
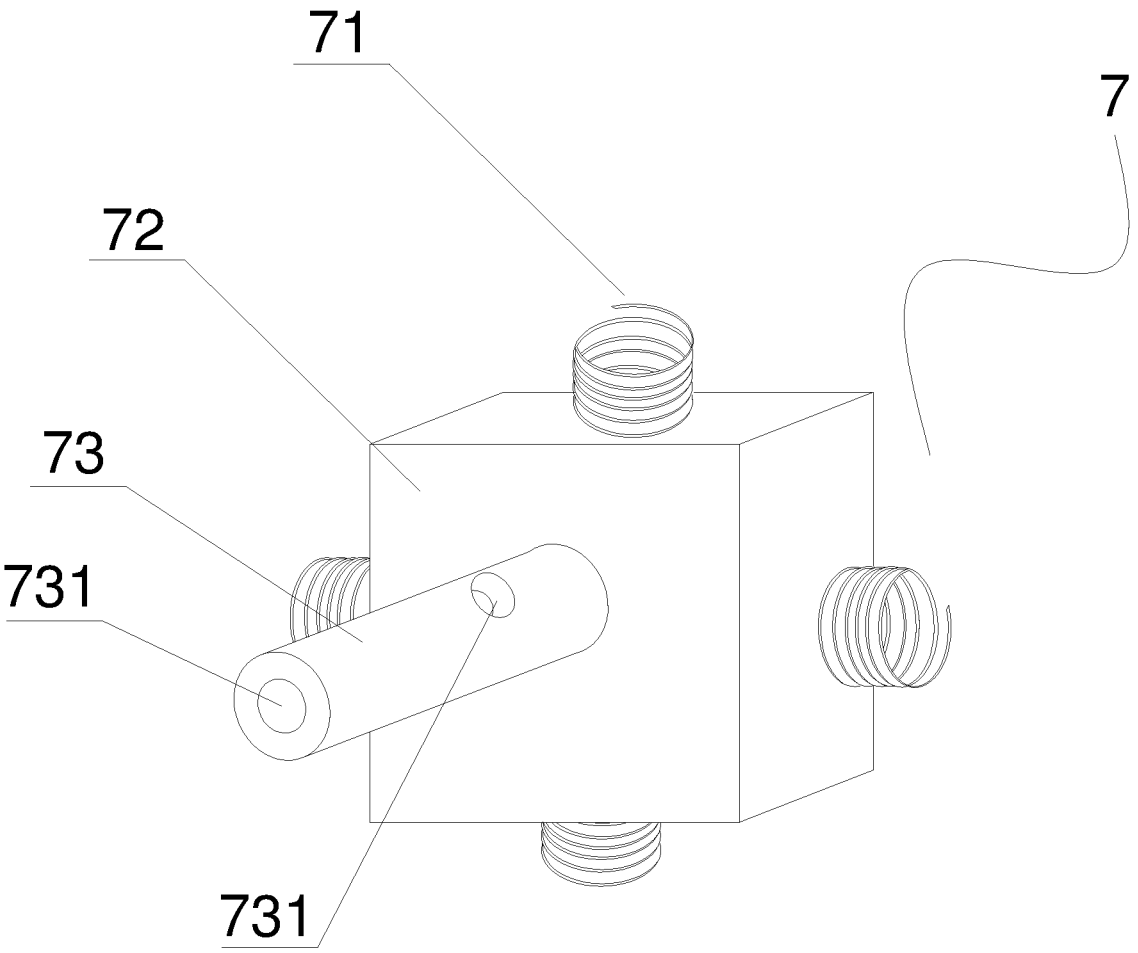
FIG. 4 is a schematic diagram of the installation of a damping structure according to the Embodiment 1 of the present Invention.
Figure 5:
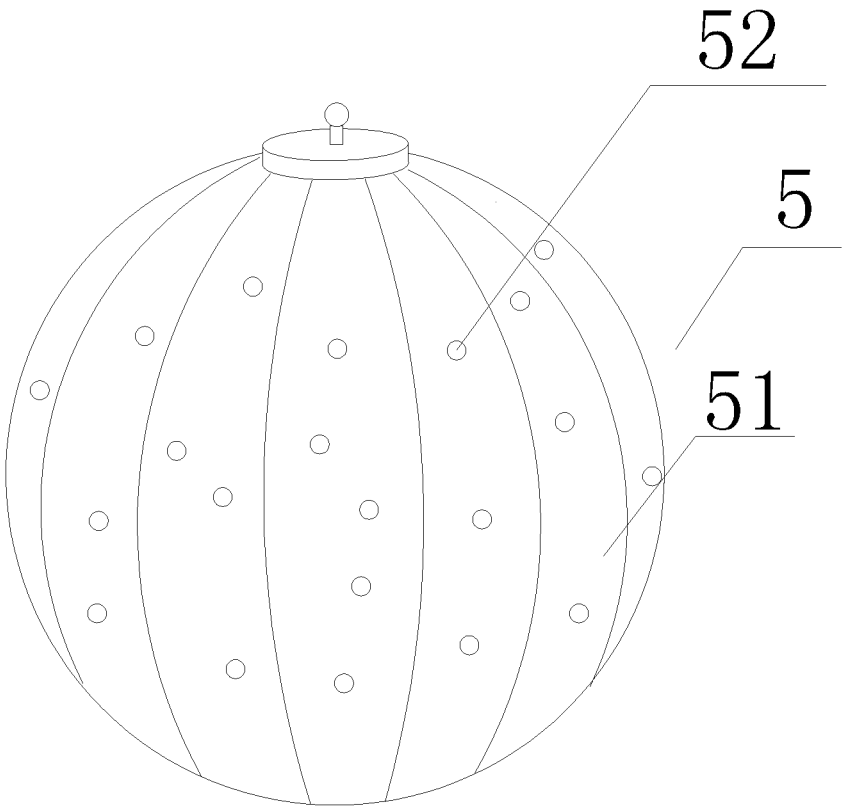
FIG. 5 is a schematic diagram of the external structure of the escape pod of Example 1.

As shown in FIG. 4, the difference between the present embodiment and the first embodiment is that the present embodiment may further include a peripheral skeleton 13. An outer side of the outer case body 5 is provided symmetrically with a plurality of connecting ends, and each connecting end connects to an inner side of the peripheral skeleton 13 through an elastic rope 12.

In the above technical solution, the survival chamber 1 has a certain damping effect and the peripheral skeleton 13 can withstand certain external force. This can ensure the safety of the survival chamber 1. Furthermore, there is a certain space between the peripheral skeleton 13 and the outer case body 5 in order to provide enough space for a person inside the survival chamber 1 to escape. This can facilitate escape of the person inside the survival chamber 1 in case the door on the outer case body 5 is blocked by external objects.

Furthermore, the outer side of the peripheral skeleton 13 is covered with flame retardant boards 11. Using the flame retardant boards 11, an excellent heat-isolating and flame-retardant effect can be achieved so as to ensure a normal living environment within the survival chamber 1.

Preferably, the peripheral skeleton 13 is a cubic structure, which has a good positioning effect and can shorten the moving distance of the escape pod.

Preferably, the flame retardant boards 11 are rockwool, which is a modified material having good flame retardant and heat insulation effect.

The other structures of this embodiment are the same as those in the first embodiment and are not described in detail here.

The embodiments of the present disclosure are described in detail in conjunction with the accompanying drawings. However, the present disclosure is not limited to the description of the embodiments. For those of ordinary skill in the art to which the present disclosure pertains, it is possible to make various changes, modifications, substitutions and variants without departing from the concept of the present disclosure, which should be covered by the scope of protection of the present disclosure.

What is claimed is:

1. An escape pod, comprising:

a spherical survival chamber;

a gimbal mechanism; and a spherical outer case body, wherein the survival chamber is mounted on an inner side of the gimbal mechanism, and an outer side of the gimbal mechanism is mounted within the outer case body, a top end and a bottom end of the outer case body are provided symmetrically with an upper connecting terminal and a lower connecting terminal, the outer case body comprises a plurality of arc-shaped plates, and two ends of each arc-shaped plate are fixedly connected to the upper connecting terminal and the lower connecting terminal respectively, an interior of the arc-shaped plates is provided with a reinforcing framework, the reinforcing framework is installed on the interior of the arc-shaped plates provided at corresponding intervals, the reinforcing framework is formed of a plurality of arc-shaped steel pipes, a top end and a bottom end of each arc-shaped steel pipe are fixedly connected to the upper and lower connecting terminals, wherein one of the arc-shaped plates is openable and used as a pod door;

wherein the gimbal mechanism comprises:

a first circular ring;

a second circular ring; and a plurality of first universal joints and second universal joints, wherein a top end and a bottom end of the first circular ring connect to an inner side of the second circular ring by two of the first universal joints respectively, and two outer level ends of the second circular ring are provided symmetrically with two connecting shafts respectively, one end of each connecting shaft is installed in an inner wall of the arc-shaped plate, and two outer level ends of the survival chamber are provided symmetrically with two of the second universal joints that connect to an inner wall of the first circular ring.

2. The escape pod according to claim 1, wherein the inner wall of the arc-shaped plate is provided with an installation groove for installing another end of each connecting shaft, and the another end of each connecting shaft is provided with a damping block in its corresponding installation groove, an outer wall of each damping block is provided symmetrically with a plurality of damping springs, and another end of each damping spring is fixedly connected to an inner wall of the installation groove.

3. The escape pod according to claim 1, further comprising a peripheral skeleton, wherein an outer side of the outer case body is provided symmetrically with a plurality of connecting ends, wherein each connecting end is connected to an inner side of the peripheral skeleton through an elastic rope.

4. The escape pod according to claim 2, further comprising a peripheral skeleton, wherein an outer side of the outer case body is provided symmetrically with a plurality of connecting ends, wherein each connecting end is connected to an inner side of the peripheral skeleton through an elastic rope.

5. The escape pod according to claim 3, wherein an outer side of the peripheral skeleton is covered with a plurality of flame retardant boards.

6. The escape pod according to claim 4, wherein an outer side of the peripheral skeleton is covered with a plurality of flame retardant boards.

7. The escape pod according to claim 1, wherein the arc-shaped steel pipes are seamless steel pipes, and oxygen is stored in the arc-shaped steel pipes; a first ventilation passage, a second ventilation passage, a third ventilation passage, a fourth ventilation passage, and a fifth ventilation passage are respectively arranged inside the connecting shafts, the second circular ring, the first universal joints, the first circular ring and the second universal joints; the arc-shaped steel pipes communicate with the first ventilation passage in the connecting shafts; the first ventilation passage, the second ventilation passage, the third ventilation passage, the fourth ventilation passage, and the fifth ventilation passage are sequentially connected; the fifth ventilation passage is connected to the survival chamber.

8. The escape pod according to claim 1, wherein each connecting terminal is provided with a pulling ring.

9. The escape pod according to claim 1, wherein a plurality of air vents is provided on the outer case body.

10. The escape pod according to claim 1, wherein a top of the pod door and the upper connecting terminal are connected by a hinge.

* * * * *